United States Patent [19]

Paddock et al.

[11] 4,404,813

[45] Sep. 20, 1983

[54] DOOR MOUNTED ELECTRONIC HOUSING ASSEMBLY FOR A REFRIGERATOR

[75] Inventors: Stephen W. Paddock, Knight Township, Vanderburgh County; Ralph Tate, Jr., Center Township, Vanderburgh County, both of Ind.

[73] Assignee: Whirlpool Corporation, Benton Harbor, Mich.

[21] Appl. No.: 255,672

[22] Filed: Apr. 20, 1981

[51] Int. Cl.[3] ..... F25B 49/00

[52] U.S. Cl. ..... 62/127; 165/11 R; 374/141; 374/152; 374/163; 374/208

[58] Field of Search ..... 73/343 R, 343 B, 349; 62/125, 127, 129; 340/585; 374/100, 141, 152, 163, 170, 183, 208, 210; 165/11 R, 13, DIG. 18

[56] References Cited

U.S. PATENT DOCUMENTS

| | | | |
|---|---|---|---|
| 3,594,752 | 7/1971 | Alton | 340/585 |
| 4,014,178 | 3/1977 | Kells | 62/3 |
| 4,092,698 | 5/1978 | Brefka | 361/399 |
| 4,148,194 | 5/1979 | Kells | 62/3 |

FOREIGN PATENT DOCUMENTS

| | | | |
|---|---|---|---|
| 2356892 | 3/1978 | France | 62/125 |

*Primary Examiner*—E. R. Kazenske
*Assistant Examiner*—Tom Noland
*Attorney, Agent, or Firm*—Wood, Dalton, Phillips, Mason & Rowe

[57] ABSTRACT

A door mounted electronic control assembly for a refrigeration apparatus, including a housing, an electronic circuit, structure for preventing the condensation of moisture on the circuit, and structure for mounting electrical components such as a temperature sensor for exposure to air within the refrigeration apparatus. The housing defines a heat retaining space in which the electronic circuit having heat generating components is disposed. Structure is provided to prevent heat from the heat retaining space from adversely affecting the operation of a temperature sensor that is carried on a spaced portion of the housing.

23 Claims, 7 Drawing Figures

FIG. 1
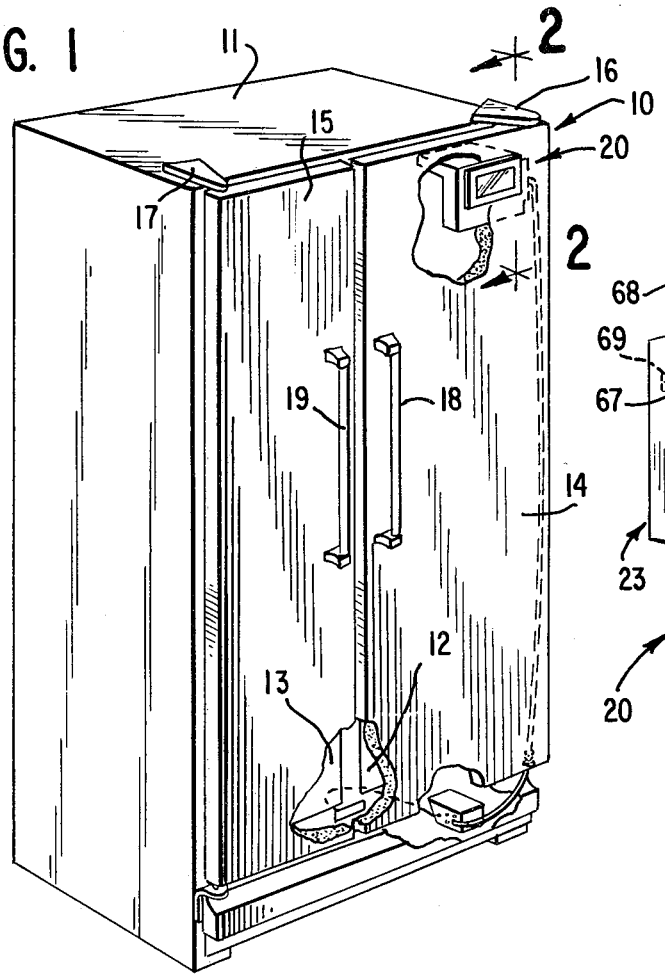
FIG. 2
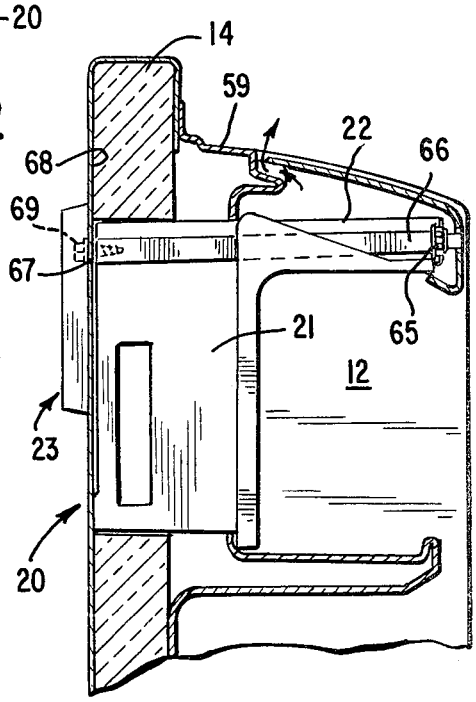
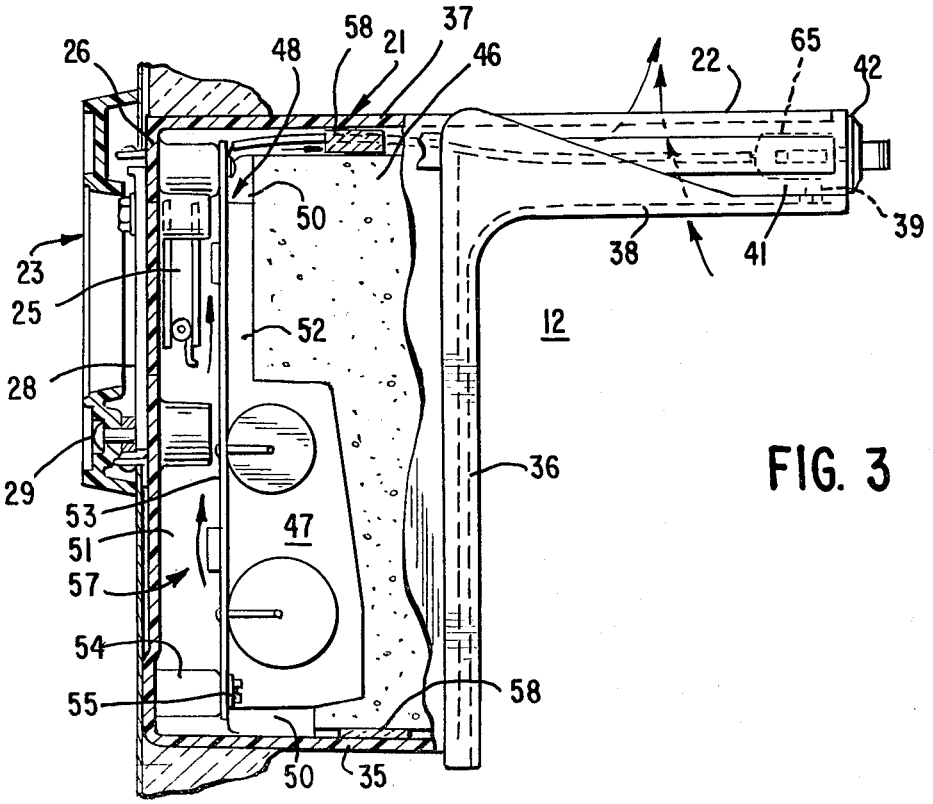
FIG. 3

FIG. 6
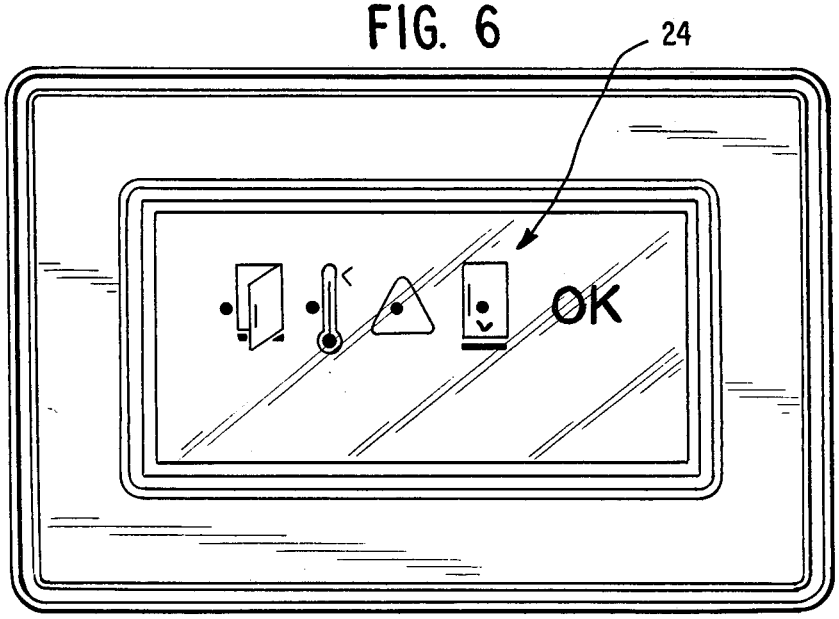
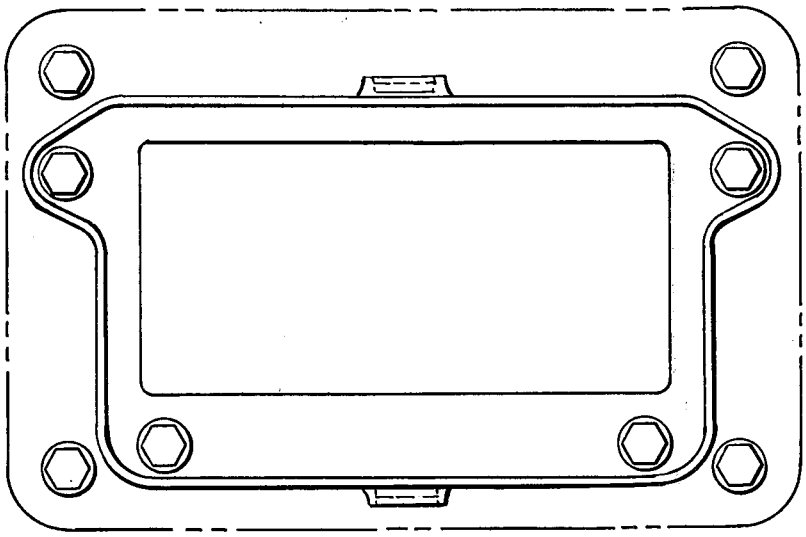
FIG. 7

DOOR MOUNTED ELECTRONIC HOUSING ASSEMBLY FOR A REFRIGERATOR

BACKGROUND OF THE INVENTION

1. Field of the Invention

This invention relates to refrigeration apparatus and in particular to means mounting and housing an electronic device within the door of a refrigeration apparatus.

2. Description of the Background Art

In U.S. Pat. No. 3,594,752 of Ahdor H. Alton, a self-contained temperature sensing and alarm unit is mounted on the outside of a refrigerated vehicle. The control is utilized in connection with shipment of frozen foods and provides a visible indication when the temperature conditions within the vehicle exceed a desired temperature range. The device includes a remotely located temperature sensing element carried on the end of a rod passed through a suitable opening in the sidewall of the refrigerated container. The structure is essentially located exteriorly of the insulated wall of the refrigerated space.

John D. Kells discloses, in U.S. Pat. No. 4,014,178, a refrigerator wherein thermometers are provided in the refrigerator doors for indicating the temperature within each of the refrigerated compartments.

In U.S. Pat. No. 4,092,698 of Paul E. Brefka, a protective case for an electrical instrument on a circuit board is provided which is adapted to be mounted in an opening provided in a support panel. The circuit board is mounted in a vertical disposition within the housing and is locked in the housing by interengagement of resilient fingers thereon.

John D. Kells discloses, in U.S. Pat. No. 4,148,194, a temperature indicating structure mounted in a refrigeration apparatus door for indicating the internal temperature of the refrigerated compartment. The control further includes an adjustable electro-thermocouple for controlling operation of the electrical refrigeration apparatus from exteriorly of the door. The control housing projects into the refrigerated space and is provided with a plurality of openings for communication of refrigerated air with the temperature sensing bulb disposed within the housing rearwardly of an insulating panel carried in the front portion of the housing. A thermometer is connected to the temperature sensing bulb by a tube and the interior of the housing is essentially free of any means for generating heat therein.

SUMMARY OF THE INVENTION

It is an object of the present invention to provide a single, self-contained means for housing electronic circuit means within the door of a refrigeration apparatus.

It is an additional object of the invention to provide means for preventing moisture condensation on the electronic circuit means.

It is a further object of the invention to provide means associated with the self-contained housing for mounting a temperature sensing means in good thermal association with the air within the refrigeration apparatus while preventing undesirable heat transfer from the electronic circuit means or ambient air to the sensing means.

It is a still further object of the invention to provide means associated with the self-contained housing for protecting the electronic circuit means and temperature sensing means from spurious effects of static electricity.

It is yet another object of the invention to provide means for permitting a display device carried by circuit means within the self-contained housing to be viewed from the exterior of the refrigeration apparatus while maintaining the thermal and moisture seal characteristics of the refrigeration apparatus.

The foregoing objects of the invention are accomplished by providing a self-contained housing which mounts within the insulation space of a refrigeration apparatus door and includes means for mounting electronic circuit means within the housing and means for mounting a temperature sensor exterior of the housing. The housing defines an insulated, sealed heat retaining space surrounding the circuit means and heat generating components are provided on the circuit means, whereby the circuit means and the air within the heat retaining space are warmed sufficiently to prevent the condensation of moisture on the circuit means.

The housing includes means for enabling heat escaping from the heat retaining space within the housing to exit from the housing by means of a convective flow path that is spaced from the temperature sensor so as to prevent the escaping heat from altering the response of the temperature sensor. The housing further includes means for permitting air from within the refrigerated space to circulate through a portion of the housing that separates the heat retaining space from the temperature sensor, and the housing is arranged such that the convective flow of escaping heat tends to induce the flow of refrigerated air through this portion of the housing.

The housing is further configured to minimize the conduction of heat through the housing walls to the temperature sensor mounting means.

The temperature sensor mounting means associated with the housing is arranged to also carry a user operated control, such as a switch or the like, and the housing includes means for establishing an electrical ground connection to the mounting means as an incident of the housing being mounted to a grounded refrigeration apparatus door. This arrangement protects the circuitry within the housing from electrostatic discharge and allows the use of sensitive, low-level electronic circuitry, such as MOS digital circuitry, within the electronic circuit means.

Thus, the housing for a refrigeration apparatus indicating means of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein:

FIG. 1 is a perspective view of a refrigeration apparatus having an improved electronic control housing embodying the invention, with portions broken away for facilitating illustration of the mounting of the housing and associated apparatus;

FIG. 2 is a fragmentary enlarged vertical section taken substantially along the line 2—2 illustrating the mounting of the housing in a door of the refrigeration apparatus;

FIG. 3 is a fragmentary enlarged side elevation of the housing with a portion broken away to illustrate the internal construction thereof in greater detail;

FIG. 6 is a front elevation of the indicator panel; and

FIG. 7 is a front elevation of the mounting panel portion thereof.

DESCRIPTION OF THE PREFERRED EMBODIMENT

Figures 4, 5:
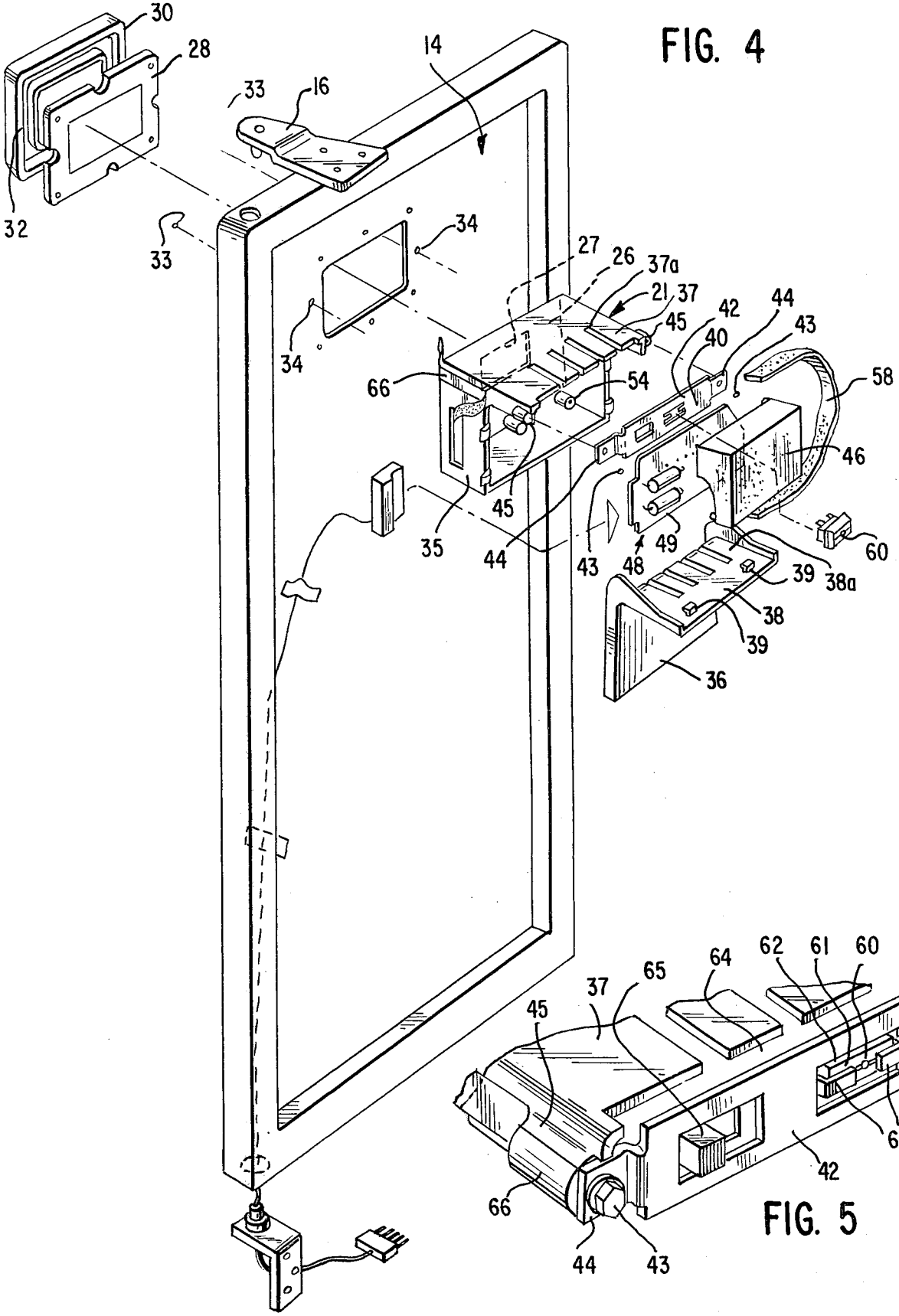
FIG. 4 is a fragmentary rear perspective, exploded view illustrating the mounting of the housing components relative to the refrigerator door.
FIG. 5 is a fragmentary rear perspective view of the housing.

In the exemplary embodiment of the invention as disclosed in the drawing, a refrigeration apparatus generally designated 10 is shown to comprise a side-by-side refrigerator-freezer apparatus including a cabinet 11 defining a first refrigerated space 12, which may comprise a refrigerated food space, and a second refrigerated space 13, which may comprise a freezer space. Spaces 12 and 13 are closed respectively by doors 14 and 15, which may be hingedly mounted to the cabinet as by hinges 16 and 17, respectively. The doors may be provided with suitable handles 18 and 19 for providing selective access to the refrigerated spaces 12 and 13 by a user.

The present invention is directed to improved means for mounting and housing an electronic control device within the door of a refrigeration apparatus. In the illustrated embodiment, an electronic display or indicator device generally designated 20 is adapted to be mounted within the door 14, adjacent the fresh food compartment space 12. A housing, generally designated 21, is mounted within the door 14 and includes an upper, rearwardly extending portion 22. An electronic display panel, shown generally at 23, is mounted to the front of the housing 21 for providing visual indications, such as indicia 24 (FIG. 6), to a user viewing the front of the refrigeration apparatus. The display 23 includes a display device, such as an electro-fluorescent display, 25 disposed within the housing 21 inwardly of a front wall 26 thereof. The front wall is provided with a suitable opening 27 through which the indicia 24 are observable from exteriorly of the refrigeration apparatus. A filter panel 28 is secured to the front wall 26 by suitable screws 29 and an outer escutcheon 30 is also secured to the refrigerator door by means of these screws. The escutcheon is positioned or aligned by means of a pair of studs 32 that project from the rear surface of the escutcheon, and a pair of cooperating nylon buttons 33 that are snap-fitted into holes 34 in the door 14.

As best seen in FIG. 4, housing 21 includes an outer boxlike portion 35 and an inner cover portion 36. The boxlike portion includes an upper, rearwardly projecting wall 37 and the cover 36 includes a cooperating inwardly projecting top wall 38. Walls 37 and 38 each define a series of cooperating slots 37*a*, 38*a*, respectively, which form a vent means, to be described later. The cover is secured to the box portion by a pair of L-shaped tangs 39 receivable in slots 40 in a horizontal, outwardly turned portion 41 of a metal mounting bracket 42 secured to the rear end of the top wall 37 by suitable screws 43 extending through end portions 44 of the mounting bracket into suitable mounting portions 45 on the top wall 37.

Forwardly of the rear cover wall 36, within box-like portion 35 of the housing 21, is an insulation block 46 which, as seen in FIG. 3, has a substantial horizontal extent. Block 46 cooperates with the front wall portions of housing 21 to define a heat retaining space 47 within the boxlike portion 35 of the housing 21. The insulating block 46 also serves to insulate space 47 from the refrigerated air within refrigerated space 12.

An electronic circuit means 48 is provided forwardly of the insulation 46 in the forward portion of the heat retaining space 47 and, in the illustrated embodiment, circuit means 48 operates to control the display device 25. The circuit means 48 is defined by a printed circuit board 49 which is spaced forwardly of the block 46 by corner posts 50 on the block 46 such that the heat retaining space 47 includes portions 51 and 52 on opposite sides of circuit board 49.

The front face 53 of the printed circuit board is spaced rearwardly of the front wall 26 of the housing by support posts 54 formed integrally with the front wall 26, and suitable screws 55. As seen in FIG. 3, the display device 25 is disposed between the front face 53 of the printed circuit board and the front wall 26 within portion 51 of heat retaining space 47.

The electronic circuit means is provided with a number of heat generating components 57 which are mounted to the printed circuit board 49. By way of example, these heat generating components may comprise conventional circuit components such as a direct current regulator, a power transistor, and various resistors. Even if not otherwise required for operation of the electronic circuit means 48, the use of heat generating components is essential for purposes of the present invention because these components heat the circuit board 49 and any other components thereon, and provide heat to the air within space 47. Heating of the circuit components and the air surrounding the circuit board effectively prevents the occurrence of undesirable condensation on the electronic circuit means 48. The problem of condensation is particularly acute when electrical components are housed within a refrigerator door that typically, forms a barrier between relatively warm, moist ambient air and cool air within a refrigerated space.

It has been found that, for an electronic circuit housed within the fresh food compartment door of a domestic refrigerator, condensation can be effectively prevented under most conditions if the heat generating components associated with the circuit means dissipate from 1 watt to 5 watts of power. A larger power dissipation would be required if the circuit were housed within the freezing compartment door. With a heat dissipation of 1 to 5 watts, the circuit means 48, the air within space 47, and the housing wall portions adjacent space 47 are warmed sufficiently as to prevent moisture condensation.

At least a portion of the heat generating means is mounted on the lower end of the printed circuit board 49 so as to provide heat to the lower portion of board 49. This is done to ensure that the circuit board 49 and air within space 47 are heated in a relatively uniform manner, even though the heated air tends to rise convectively.

As illustrated in FIGS. 3 and 4, a strip of flexible foam insulation 58 is extended about the insulation block 46 so as to define additional sealing means for minimizing the leakage of warm air from the heat retaining space 47. Some heat will gradually escape from the space 47, due to thermal conduction through the walls of housing 21 and convective air flow upward within space 47 and along the top inside portion of the housing 21, as illustrated by the arrows in FIG. 3. The slots 37*a* in housing top wall 37 allow any such warm air escaping from space 47 to exit from housing 21 before reaching the vicinity of a temperature sensor 60 carried by the rearwardly extending portion 22 of housing 21. This arrangement prevents the temperature sensor 60 from being adversely affected by escaping warm air.

The slots 38*a* formed in cover 36 permit circulation of cool air from the refrigerated space 12 through the rearwardly extending housing portion 22, to further ensure that the temperature sensor 60 is responsive to the temperature of the air within the refrigerated space 12 and not influenced by heat escaping from space 47. It is believed that the small convective flow of warm air from space 47, as illustrated by the arrows in FIG. 3, tends to induce a positive, upward flow of cool air from refrigerated space 12 through the rearwardly extending housing portion 22, as also illustrated by the arrows in FIG. 3.

As illustrated in FIG. 2, warm air escaping from housing 21 is permitted to enter the refrigerated space 12 by means of a gap provided in the inner door liner 59. Other means, such as slots, could alternatively be provided in door liner 59 to allow the warm air to escape.

The temperature sensor 60 may comprise a conventional thermistor sensing device. As seen in FIG. 5, the thermistor is mounted to an insulating support block 61 which is snap-fitted in an opening 62 of the support metal bracket 42. A pair of tabs 63, formed integrally with bracket 42, overlie the space in which the temperature sensor 60 is housed and serve as a means for dissipating any discharge of static electricity occurring in the vicinity of the sensor 60, such as can be inadvertently caused by a user of the refrigeration apparatus.

As further illustrated in FIG. 5, the top housing wall 37 defines a recess 64 which separates bracket 42 from the wall 37. Cover top wall 38 (FIG. 4) is constructed such that it defines a similar recess (not shown) with bracket 42 when the cover 36 is snapped in place on housing boxlike portion 35. Thus, the support bracket 42 that carries sensor 60 is spaced from the body of housing 21 to facilitate the free circulation of air from refrigerated space 12 about the sensor 60. This mounting arrangement also minimizes the conductive transfer of heat from the housing top wall 37 to bracket 42.

It has been found that a housing constructed with the heat flow and heat transfer prevention means described above improves the response of the temperature sensing means 60, as compared to a housing and mounting arrangement of similar overall shape but without the heat flow and heat transfer prevention means. By way of example, an electronic circuit dissipating as little as 1 watt has been found to produce a 3° F. to 5° F. increase in the temperature sensed by sensor 60 for a housing that does not contain slots 37*a*, 38*a* and recess 64. Such a heat induced offset is undesirable where it is desirable that sensor 60 accurately indicate the temperature within refrigerated space 12.

The circuit means further includes a manually operable switch 65 which is also mounted to the metal support bracket 42 for use in selectively actuating or resetting the display device 25 through the operation of the circuit means. As the circuit means may include components which are sensitive to high electrostatic potential, it is desirable to ground the switch 63 and metal bracket 42. For this purpose, switch 65 is grounded to bracket 42 and a grounding strap 66, which may comprise foil tape, is disposed in electrical contact with the mounting bracket 42 and extended forwardly along one side of the housing 21, as seen in FIGS. 4 and 5. A front end portion 67 of the grounding strap is turned to lie between the front wall 26 of the housing and the metal inner wall 68 of the door 14, as shown in FIG. 2. A mounting screw 69 may be provided for effectively positively electrically connecting the grounding strap portion 67 to the metal wall 68 which, in turn, is grounded in a conventional manner so as to effectively ground the switch 65 and mounting bracket 42, thereby dissipating any static electricity which may be transferred from the user in operating the switch 65, thereby preventing spurious operation of the electronic circuit means 48.

Thus, the present invention comprehends an improved self-contained means for mounting and housing an electronic circuit means and temperature sensing means within the door of a refrigeration apparatus. The invention includes means for preventing the condensation of moisture on the circuit means, means for ensuring that the temperature sensing means is in effective heat transfer association with the refrigerated air within the refrigeration apparatus, and means for protecting the sensor and circuit means from possible adverse effects due to static discharge caused by user operation of a control switch or device associated with the circuit means. The invention further includes means for permitting a display device carried by the circuit means to be viewed from the exterior of the refrigeration apparatus.

While the specific circuitry of the circuit means forms no part of the present invention, information on a suitable sensing and display circuit may be obtained by reference to copending U.S. Letters Patent application, Ser. No. 252,673, of Stephen Paddock entitled "Electronic Sensing and Display System for a Refrigerator", filed of even date herewith, which application is incorporated by reference herein. It will be appreciated that, while the present invention has been illustrated with reference to an electronic sensing and display system for a refrigerator, the invention is of broad application and can be used to house a wide variety of electronic control means within the door of a refrigeration apparatus.

The foregoing disclosure of a specific embodiment is illustrative of the broad inventive concepts comprehended by the invention.

Having described the invention, the embodiments of the invention in which an exclusive property or privilege is claimed are defined as follows:

1. In a refrigeration apparatus having a cabinet defining a refrigerated space and including an insulated door for selectively closing said space, an electronic housing assembly comprising:

housing means including a first portion defining a circuit receiving space, said housing defining a front wall substantially closing the front of said circuit receiving space;

electronic circuit means including heat generating means disposed within said circuit receiving space;

heat transfer prevention means disposed within said housing for substantially retaining heat generated by said heat generating means within said housing; and mounting means for mounting said housing means within insulation of said door, whereby sufficient heat is retained in said circuit receiving space by the substantial enclosure thereof by the heat transfer prevention means, the door insulation, and the housing front wall to effectively prevent moisture condensation on said circuit means.

2. The refrigeration apparatus of claim 1 wherein said heat transfer prevention means includes thermal insulation material positioned between said refrigerated space and said circuit receiving space.

3. The refrigeration apparatus of claim 2 wherein said housing defines a second portion carrying a temperature sensing means and said thermal insulation material is interposed between said circuit receiving space and said temperature sensing means.

4. The refrigeration apparatus of claim 3 wherein said housing includes means for permitting air from said refrigerated space to enter said housing at at least one point between said circuit receiving space and said temperature sensing means.

5. The refrigeration apparatus of claim 4 wherein said means for permitting the entry of refrigerated air includes a plurality of openings located in said housing so as to define a flow path by which said refrigerated air can enter and exit from said housing means.

6. The refrigeration apparatus of claim 5 wherein said openings are arranged to facilitate the convective flow of air through said housing means.

7. The refrigeration apparatus of claim 6 wherein said openings are further arranged to permit warm air escaping from said circuit receiving space to exit from said housing means by convective flow.

8. The refrigeration apparatus of claim 4 wherein said means for permitting the entry of refrigerated air comprises a recess formed in said second housing portion adjacent said temperature sensing means so as to define an air flow space between said sensing means and said second housing portion.

9. The refrigeration apparatus of claim 2 wherein said thermal insulation material comprises a block of foam insulation material.

10. The refrigeration apparatus of claim 1 wherein said circuit receiving space is defined by a plurality of housing wall means and said heat transfer prevention means comprises a block of thermal insulation material extending substantially between said wall means adjacent said circuit receiving space.

11. The refrigeration apparatus of claim 1 wherein said housing further includes a second portion spaced from said first portion, electrical component mounting means carried by said second housing portion for retaining an electrical component such as a temperature sensing device, manually operable means carried by said second portion of the housing, and means for grounding said electrical component mounting means extending around said circuit receiving space to said door.

12. The refrigeration apparatus of claim 11 wherein said component mounting means comprises an electrically conductive mounting bracket.

13. The refrigeration apparatus of claim 12 further including means for electrically grounding said conductive bracket to said door.

14. The refrigeration apparatus of claim 13 wherein said grounding means comprises an electrical conductor extending along said housing between said bracket and said portion of said housing retained against said door, whereby said bracket is electrically grounded to said door as an incident of said housing being mounted to said door.

15. The refrigeration apparatus of claim 11 wherein said component mounting means comprises a bracket mounted to said second housing portion and having a component mounting portion that is spaced from said housing.

16. The refrigeration apparatus of claim 15 wherein said spaced bracket portion is disposed within said refrigerated space.

17. In a refrigeration apparatus having a cabinet defining a refrigerated space and an electrically grounded door for selectively closing said space, an electronic housing assembly comprising:

housing means including a first portion defining a circuit receiving space and a second portion spaced from said first portion;

mounting means for mounting said housing within the insulation space of said refrigerator door with at least a portion of said housing being retained against said door; and electrical component mounting means carried by said second housing portion for retaining a temperature sensing device or other electrical component on a rearward exterior portion of said housing, said component mounting means comprising an electrically conductive mounting bracket, said apparatus further including means for electrically grounding said conductive mounting bracket to said door comprising an electrical conductor extending along said housing between said bracket and said portion of said housing retained against said door, whereby said bracket is electrically grounded to said door as an incident of said housing being mounted to said door, and said bracket carrying at least one electrical component thereon and one or more electrically conductive tabs outwardly of and adjacent to said component whereby an electrostatic discharge is received by said tabs instead of said component.

18. In a refrigeration apparatus having a cabinet defining a refrigerated space and a door for selectively closing said space, an electronic housing assembly comprising:

housing means including a first portion containing a circuit receiving space defined by a plurality of housing wall means and a second portion spaced from said first portion;

electronic circuit means including heat dissipating means disposed within said circuit receiving space;

heat transfer prevention means comprising a block of thermal insulation material extending substantially between said wall means adjacent said circuit receiving space and disposed within said housing for causing heat dissipated by said heat dissipating means to be retained substantially within said circuit receiving space;

temperature sensing means mounted on said second housing portion;

resilient insulating material extending between said block of thermal insulation material and said housing walls; and mounting means for mounting said housing means within insulation of said door, whereby sufficient heat is retained in said circuit receiving space by the substantial enclosure thereof by the heat transfer prevention means, the door insulation, and the housing front wall to effectively prevent moisture condensation on said circuit means.

19. In a refrigeration apparatus having a cabinet defining a refrigerated space and including an insulated door for selectively closing said space, an electronic housing assembly comprising:

housing means including a first housing portion having a front wall and means defining a circuit receiving space adjacent said front wall and a second housing portion spaced rearwardly of said first housing portion;

circuit mounting means disposed within said circuit receiving space for mounting a heat generating electronic circuit within said circuit receiving space rearwardly of said front housing wall;

heat transfer inhibiting means disposed within said housing rearwardly of said circuit receiving space;

temperature sensor means carried by said second housing portion and located rearwardly of said heat transfer inhibiting means; and means for mounting said housing to said door with said housing front wall being aligned substantially parallel to the plane defined by said door and within insulation of said door, whereby sufficient heat is retained in said circuit receiving space by the substantial enclosure thereof by the heat transfer inhibiting means, the door insulation, and the housing front wall to effectively prevent moisture condensation on said circuit and is effectively prevented from affecting said temperature sensor means.

20. The refrigeration apparatus of claim 19 wherein said circuit mounting means comprises means for securing a printed circuit board parallel to and in close proximity with said housing front wall.

21. The refrigeration apparatus of claim 19 wherein said housing front wall includes means defining an aperture through which a component located within said circuit receiving space can be viewed.

22. The refrigeration apparatus of claim 21 wherein said refrigeration apparatus door includes an inner surface and said means for mounting said housing to said door comprises means for mounting said housing front wall against said door inner surface.

23. The refrigeration apparatus of claim 22 wherein said refrigeration apparatus door defines an aperture aligned with said aperture in said front housing wall and further including an escutcheon panel and sealing means arranged to overlie and surround at least one of said apertures.

* * * * *